United States Patent [19]

Kaltner

[11] Patent Number: 4,728,938

[45] Date of Patent: Mar. 1, 1988

[54] SECURITY TAG DEACTIVATION SYSTEM

[75] Inventor: George W. Kaltner, Mt. Holly, N.J.

[73] Assignee: Checkpoint Systems, Inc., Thorofare, N.J.

[21] Appl. No.: 817,843

[22] Filed: Jan. 10, 1986

[51] Int. Cl.[4] ..... G08B 13/24

[52] U.S. Cl. ..... 340/572; 340/527; 340/691

[58] Field of Search ..... 340/572, 551, 691, 527

[56] References Cited

U.S. PATENT DOCUMENTS

| | | | |
|---|---|---|---|
| 3,828,337 | 8/1974 | Lichtblau | 340/572 |
| 3,919,704 | 11/1975 | Williams et al. | 340/572 |
| 3,938,044 | 2/1976 | Lichtblau | 340/572 |
| 4,117,466 | 9/1978 | Lichtblau | 340/572 |
| 4,243,980 | 1/1981 | Lichtblau | 340/572 |
| 4,251,808 | 2/1981 | Lichtblau | 340/572 |
| 4,498,076 | 2/1985 | Lichtblau | 340/572 |

*Primary Examiner*—Glen R. Swann, III

*Attorney, Agent, or Firm*—Alfred Stapler

[57] ABSTRACT

Security tags which bear a resonant circuit made of conductors on opposite sides of a dielectric are deactivated by applying to a tag sufficiently high RF power at the resonance frequency to produce breakthrough between opposed conductors. A tag presence alert signal is intentionally extended beyond the period of active tag presence detection. During high power operation, the system inhibits other nearby RF deactivating and electronic article surveillance systems. The RF transmissions of all these systems may also be slaved. The high power RF produced by the deactivating system is principally dissipated where it causes no undesirable heating effects.

13 Claims, 2 Drawing Figures

SECURITY TAG DEACTIVATION SYSTEM

BACKGROUND OF THE INVENTION

This invention relates to electronic systems in which a resonant circuit is detected when brought into proximity to certain electronic equipment. Such systems are utilized particularly for security purposes, such as shoplifting prevention, but are not limited to such applications.

In their application to shoplifting prevention, such systems include equipment for establishing a radio-frequency (RF) field at the exit of, say, a retail store. Attached to each article of merchandise in the store which is to be protected from shoplifting is a tag bearing the resonant circuit, which is constructed to have a resonance frequency within the range of frequencies of the field. When the article is properly paid for, the clerk at the check-out counter either removes this tag, or else renders it effectively inactive by the application of a shielding label. Otherwise, the system senses the passage of the still-active tag through the RF field upon exiting and gives an alarm. For convenient reference, such systems are hereafter referred to as electronic article surveillance, or EAS systems.

The resonant circuit borne by each tag used with such EAS systems is a multilayer structure, having a dielectric substrate, on opposite sides of which are conductive layers so shaped as to define a capacitor and an inductor which cooperate to provide the circuit resonant at the desired frequency.

It has previously been proposed to render such a tag inactive by a more "elegant" technique than that of physical removal, or shielding. That improved technique is disclosed in U.S. Pat. No. 4,498,076, issued Feb. 5, 1985, in the name of George J. Lichtblau. It involves providing the tag itself with a localized region where the spacing between conductors on opposite sides of the dielectric substrate is reduced, e.g. by an indentation. It further involves providing electronic equipment which senses the presence of a tag (by a process generally similar to that used by the EAS system) and thereupon establishes a RF field at frequencies which include the resonant frequency of the tag and at a sufficient power level that breakdown occurs between conductors on opposite sides of the dielectric. This "deactivates" the tag and does so by purely electronic means.

In order to prevent confusion of terms between the EAS system previously described, and the electronic equipment used to sense and then deactivate the resonant circuit-bearing tags, the latter is referred to herein as an electronic deactivation, or ED system.

Deactivation using an ED system, in accordance with said U.S. Pat. No. 4,498,076, is a sound concept. However, there are matters of practical implementation which merit consideration beyond what is given to them in said Patent.

These include such items as how to avert possible interference between nearby ED systems, or between ED and EAS systems, how to provide suitable indications of tag deactivation, and how to dissipate the relatively high RF power which is developed by the ED system during deactivation.

It is an object of the present invention to deal with the matters noted above.

SUMMARY OF THE INVENTION

This and other objects which will appear are accomplished in accordance with the present invention as follows.

Coupling is provided between any given ED system and any other such system or any EAS system which is near enough to create mutual interference. This coupling is used to inhibit the tag detection function of these other systems, whenever a particular ED system is operating at its high power, or deactivating level. This, together with slaving of the RF transmissions from all these systems prevents possible interference between them.

Deactivation is indicated by the ending of an alert signal which is started when a tag is detected by means of the ED system. Moreover, for reasons which will appear, this alert signal is deliberately extended by a predetermined interval beyond the time at which tag detection ceases.

As for power dissipation, means are provided for accomplishing this at a location remote from that at which the tag deactivation itself is performed.

BRIEF DESCRIPTION OF THE DRAWINGS

For further details, reference is made to the discussion which follows, in light of the accompanying drawings wherein.

The same reference numbers designate similar parts in the different figures.

DESCRIPTION OF THE PREFERRED EMBODIMENT

Figure 1:
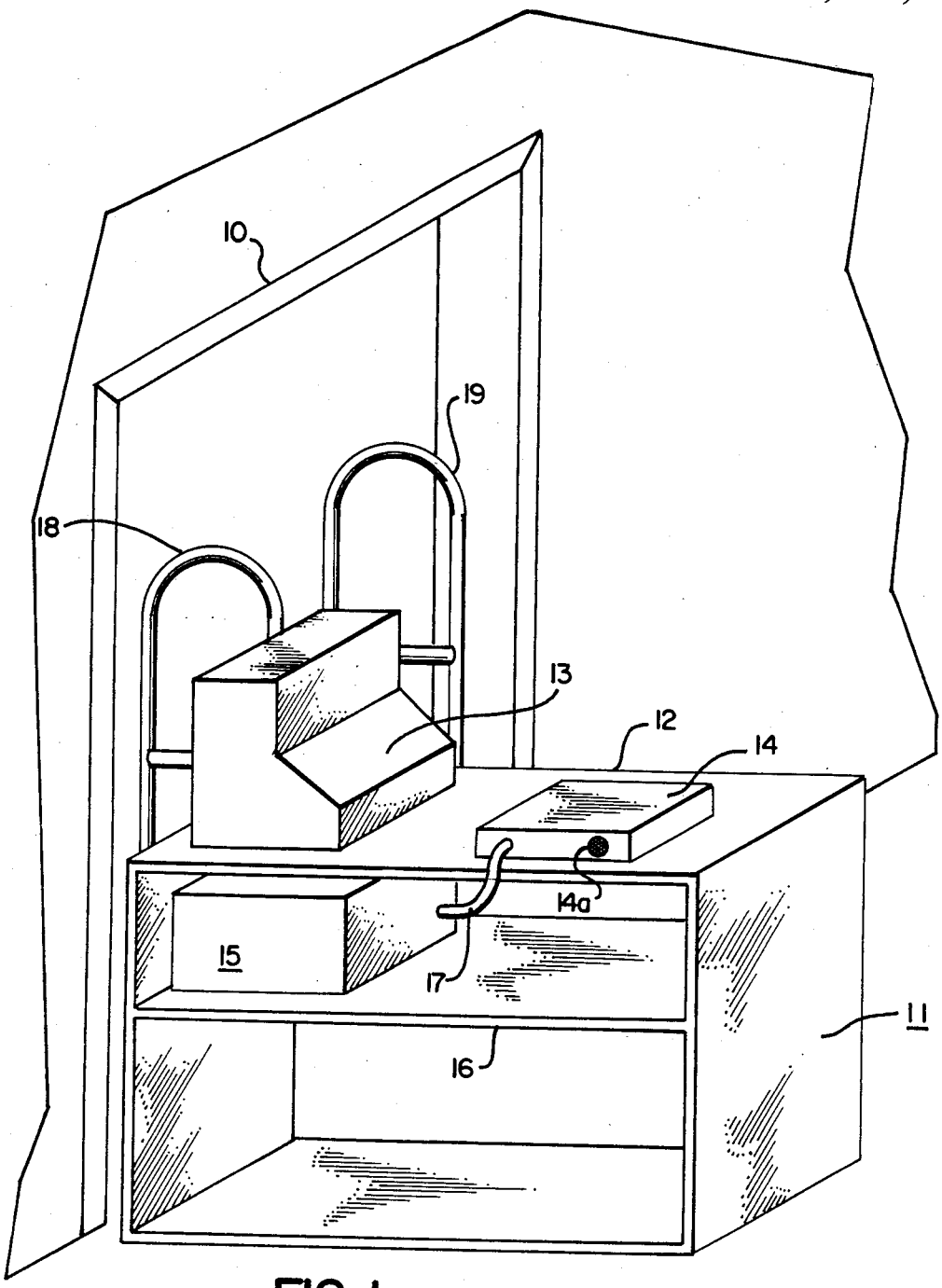
FIG. 1 shows, in simplified, diagrammatic form, the major elements and layout of an embodiment of the invention.

Referring to FIG. 1, this shows in isometric view the check-out area of a retail store, such as a drug store, for example.

The store exit opening is designated by reference numeral 10. Near that exit is the check-out counter 11, viewed in FIG. 1 from the side on which the clerk stands while checking out merchandise. The customer, of course, stands on the opposite side of counter 11 and places the merchandise to be checked out on the countertop 12. Also on countertop 12 is the cash register 13 and a unit 14, which forms part of the ED system embodying the present invention. Another part of that ED system, namely a cabinet 15, is positioned on a shelf 16 below the countertop 12, and is connected to unit 14 by cabling 17. Near the exit end of checkout counter 11 and also adjacent to exit 10, there are positioned antennas 18 and 19, forming part of the EAS system with which the ED system cooperates.

In the version of all this equipment which constitutes the embodiment currently preferred by this inventor, the EAS system of which antennas 18 and 19 form a part is the type which is sold by Checkpoint Systems, Inc., of Thorofare, New Jersey, under the model designation Checkpoint Mark III. Briefly, it comprises an RF transmitter, which is conventionally housed in a cabinet mounted between the vertical legs of one of the EAS antennas, say antenna 18, shown in FIG. 1, but too low to be visible in FIG. 1. This transmitter produces a signal which recurrently sweeps through a frequency range centered, say, at 8.2 MHz and extending 0.8 MHz above and below that center frequency. This signal is radiated by the transmit antenna 18 and picked up by receive antenna 19. The latter is connected to a receiver, housed in a cabinet (also not visible in FIG. 1) mounted between the legs of EAS antenna 19. That EAS receiver is constructed so as to process the signal received from antenna 18 in a manner which detects the presence, in the passageway defined by antennas 18 and 19, of a resonant circuit tuned to a frequency within the range of sweep of the transmitter, i.e. between 7.4 and 9.0 MHz. Upon detection of such a resonant circuit, an alarm indication is given. In this manner, an attempt to remove an article of merchandise which is protected by a tag bearing such a resonant circuit will be detected and can then be followed by the appropriate security measures.

The specific configuration used for antennas 18 and 19, and the specific circuitry to be used in conjunction therewith does not constitute a part of the present invention and may, furthermore, take any one of various well-known forms. However, in the form which this inventor currently prefers, antennas 18 and 19 will have a configuration as disclosed in U.S. Pat. Nos. 4,243,980, issued Jan. 6, 1981 and 4,251,808, issued Feb. 17, 1981. The receiver circuitry which cooperates with antenna 19 will include means for processing the received signals so as to determine whether a resonant circuit-bearing tag is present near the antennas 18, 19. This signal processing means may also take various known forms, for example, those disclosed in U.S. Pat. Nos. 3,828,337, issued Aug. 6, 1974 and 4,117,466, issued Sept. 26, 1978. The contents of all four of these prior patents are included in and made part of the present disclosure by reference, as if set forth in full herein.

Turning now to the ED system of FIG. 1, the countertop unit 14 is preferably a flat "pad", made of non-conducting material, such as a plastic. This pad is preferably about 16 inches by 16 inches in area and about ¾ inch high. It encloses transmitter and receiver antennas, which may be generally similar to antennas 18 and 19 of the EAS system, but of course now much reduced in dimensions and located in the same horizontal plane as the pad 14. This pad also encloses a buzzer, the grille **14*a* of which is visible in FIG. 1. It will be understood that there need not be such a grille and that the buzzer may be fully enclosed in pad 14**.

Cabinet 15 houses the electronic circuitry which forms part of the same ED system. For further description of that electronic circuitry, reference is now made to its illustration in the block diagram of FIG. 2. That electronic circuitry comprises a generator 20 of radio frequency (RF) signals which is controlled so as to vary its frequency of operation recurrently over a predetermined range, e.g. the same 7.4 to 9.0 MHz range as in the EAS system. The output of generator 20 may be supplied via switch 21 to a power amplifier 22, which is so constructed that its gain (and resulting output power) may be varied between a relatively low and a relatively high level by a control signal supplied via connection 23. By means of switch 21, an RF signal similar to that from generator 20, but obtained in a manner explained later, may be used in place of that from generator 20 to drive amplifier 22. The output signal from amplifier 22 is supplied to a filter 24, which suppresses high frequency components above, say 12 MHz, and from there via coupling transformer 25 and shielded leads 26, 27, to the transmit antenna within pad 14 (FIG. 1). That transmit antenna is shown diagramatically in broken lines in FIG. 2, where it is designated by reference numeral 28. Also shown diagrammatically in broken lines in FIG. 2 are the continuations of leads 26, 27 extending to transmit antenna 28 via cabling 17 (FIG. 1).

Also connected to the same transmit antenna 28 within pad 14 via cabling 17 (FIG. 1) are shielded leads 29, 30. As shown diagramatically in broken lines, these leads are connected in parallel to leads 26, 27 at the antenna connections within pad 14. Within cabinet 15, they are connected to a series resistance-capacitance circuit 31, 32 as shown in FIG. 2.

Figure 2:
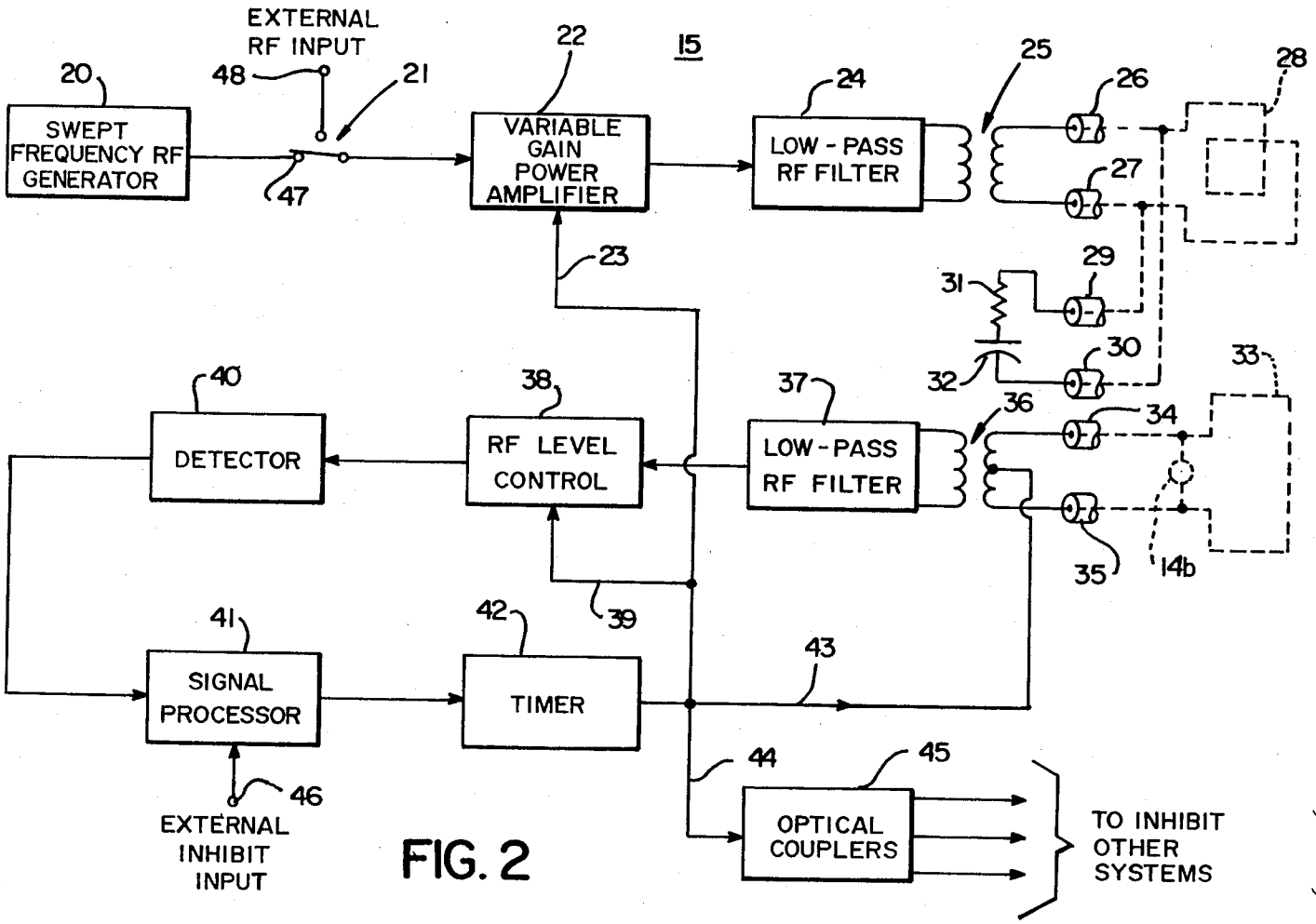
FIG. 2 shows, in block diagram form, the electronic components of such an embodiment.

The receiver antenna within pad 14 (FIG. 1) is shown diagramatically in broken lines in FIG. 2 designated by reference numeral 33. It is connected to the circuitry in cabinet 15 by shielded leads 34, 35, via cabling 17 and coupling transformer 36. The signals so received are supplied to a low-pass filter 37, similar to filter 24. The output signal from that filter 37 is supplied to a circuit 38 which, under the control of a signal from connection 39, is capable of passing the signal which it receives from filter 37 with either relatively low or relatively high attenuation. The signal from this control circuit 38 is supplied to a detector 40 which detects and produces a signal representative of the modulation present on the RF signal from circuit 38. The signal from detector 40 is supplied to a signal processing circuit 41 which, in essence, utilizes that supplied signal to determine whether or not a resonant circuit-bearing tag is present in the vicinity of the pad 14. This circuit 41 puts out a distinctive output signal whenever it does determine that such a tag is present. This tag-representative output signal is supplied to a timing circuit 42, which extends its duration by a predetermined time interval.

The resulting signal produced by timing circuit 42 is supplied, via previously mentioned connections 23 and 39, to power amplifier 22 and control circuit 38, respectively. In addition, this signal is supplied, via connection 43, to the center tap of the primary winding of transformer 36, and via connection 44, to the light-emitting elements of each of a plurality of optical couplers 45.

This ED system functions as follows.

When no resonant circuit-bearing tag is present in the vicinity of pad 14 (FIG. 1), the power amplifier 22 (FIG. 2) is normally maintained at its relatively low power level by the control signal supplied from timing circuit 42 via connection 23. This power level may be such as to provide an output power at transformer 25 of approximately 2 watts in a current embodiment.

The signal so transmitted via transmit antenna 28 is received by the receive antenna 33 and supplied via transformer 36 and filter 37 to level control circuit 38. Since no tag is present in this situation, the output signal supplied from timing circuit 42 to control circuit 38 via connection 39 will be such as to maintain that control circuit in its low attenuation mode. The received signal passed by circuit 38 will undergo RF detection in circuit 40 and signal processing in circuit 41. This signal processing will yield an output from circuit 41 which indicates the absence of a resonant circuit-bearing tag from the vicinity of pad 14. Timing circuit 42 will remain inactive in response to such an output signal from circuit 41, and will simply maintain that output signal for as long as it is present.

Now assume that a customer steps up to the counter 11 (FIG. 1), carrying an article of merchandise which is protected by a resonant circuit-bearing tag, and which that customer desires to purchase. It is now the duty of the check-out clerk to see to it that this article is brought close enough to the pad 14, so that its presence is detected by the ED system. Such detection takes place when the resonant circuit sufficiently distorts the signal transmitted from and received back at pad 14 so that the signal processing circuitry 41 determines that the distortion is attributable to a tag. When that takes place, the output signal from circuitry 41 undergoes a distinctive change, e.g. from a low to a high value. This change is also reflected at the output of timing circuit 42. As a result, several other actions take place within the ED system.

Via connection 23, the gain of the power amplifier 22 is raised to produce a transmitted signal at the previously mentioned relatively high power level. This may be of the order of 10 watts in a current embodiment.

Via connection 39, the RF level control circuit 38 is changed to its relatively high attenuation condition. The change is preferably such that the output signal from circuit 38 will remain at substantially the same level during the high-power operation of amplifier 22 as during its low-power operation. In this way, the detector circuitry 40 is protected from RF overload.

Via connection 43, the center tap of transformer 36, and leads 34, 35, the buzzer housed in pad 14 is actuated. This buzzer is shown diagrammatically in broken lines, designated by reference numeral **14*b* (FIG. 2). In practice, an RF-isolated dc path will be provided to buzzer 14*b***.

Finally, via connection 44, the optical couplers 45 are energized.

All of the conditions described above will be maintained for as long as signal processing circuitry 41 continues to detect a tag-representative received signal, plus the additional predetermined period of time established by timing circuit 42, as previously noted. At the end of this total time period, the output signal from circuit 42 will revert to its level corresponding to the absence of a resonant circuit-bearing tag. This, in turn, will cause power amplifier 22 to revert to its relatively low power mode, control circuit 38 to revert to its low attenuation mode, the buzzer **14*b* to stop operating, and the optical couplers 45** to be deenergized. The overall ED system is then ready to respond to another article of merchandise protected by a resonant circuit-bearing tag, in the same manner as described above.

The purpose of providing timing circuit 42 is a follows. There are circumstances under which the detection of the presence of a tag in the vicinity of pad 14 occurs so fleetingly that an alerting signal of the same duration from buzzer 14 could easily be overlooked.

One such circumstance arises if the article of merchandise to which the tag is attached is brought close to pad 14 only fleetingly and is removed before deactivation following detection can take place. In many retail stores, merchandise is provided with tags only on a selective, or sample basis; therefore the check-out clerk might then erroneously conclude that the particular article had not been tagged, and make no further effort to deactivate.

Another such circumstance might arise if deactivation takes place very rapidly after detection. The clerk might then conclude, again erroneously, that the tag had not yet been deactivated, and therefore continue futile attempts to do so.

Timing circuit 42 forestalls these problems, by making sure that an alert signal of sufficient duration will be given so that it is highly unlikely that it will not be perceived. It has been found that a suitable duration for the time period by which timing circuit 42 extends this alert signal is approximately 120 milliseconds.

It will be noted that the output signal from timing circuit 42 is supplied not only to buzzer **14*b*, where it extends the alert signal, but also to power amplifier 22, attenuation control circuit 38, and optical couplers 45. This is not essential, because, once tag detection ceases, these other elements may all be allowed to return to their modes corresponding to low-power output from amplifer 22**. However, it is preferred to also extend their high power modes because this further insures the reliable determination that cessation of detection was due to deactivation of the tag.

Attention is invited to optical couplers 45. These may have their respective outputs connected to one or more other ED systems or EAS systems in the vicinity of the particular ED system shown in FIGS. 1 and 2. These outputs may be used to temporarily inhibit the operation of these other systems, during the periods that the present ED system is in its high power mode. That prevents the operation of one such system in its high power mode from causing other nearby systems to erroneously give a tag presence indication. That could otherwise happen, if ED equipped check-out counters and/or EAS equipped exits are located close to one another. The same inhibiting possibility should, of course, also prevail for the particular ED system shown in the present case. This is provided by terminal 46 (FIG. 2). This terminal may be used to apply an external signal, e.g. from another nearby ED system, to inhibit the signal processing circuitry 41 from putting out a signal which represents the presence of a tag in the vicinity of pad 14. By using optical couplers, difficulties which may be created by providing d-c connections between systems are avoided.

Attention is also directed to switch 21. When connected to terminal 47 (as shown), the power amplifier 22 receives its drive from generator 20. By changing the switch connection to terminal 48, it becomes possible to utilize an external RF signal to drive the power amplifier 22. Such an external signal is typically derived from a nearby EAS system. The reason for using such an external drive signal is as follows. If the ED system of FIGS. 1 and 2 is permitted to operate with its own RF generator (generator 20 in FIG. 2) while a nearby EAS system operates with its own RF generator, then the interaction between the resulting transmitted signals can create distortions of the signal picked up by the receive antenna of the ED or the EAS system which will be similar to those produced by the presence of a tag. This would then result in a false alarm from the ED or EAS system. By driving both systems with the same RF signal, this can be avoided.

Attention is invited to R-C network 31, 32 in FIG. 2. This network, and particularly its resistive component 31, is used to dissipate the relatively high power generated when the amplifier 22 is in its high power mode. In this way, that power is dissipated mainly within cabinet 15, which can be conveniently equipped with the appropriate heat sink and cooling facilities, rather than in pad 14, which is preferably completely enclosed and might therefore tend to become undesirably warm to the touch under frequent use.

In the version which is currently preferred by the present inventor, the ED system which is illustrated in FIGS. 1 and 2 is based on the same operating principles as the EAS system previously described. That is, the frequency of the transmitted signal is swept recurrently through a range of frequencies which includes that at which the tags to be deactivated are resonant. When such a tag is brought near the pad 14, recurrent distortions in the received signal occur. These are utilized by the signal processing circuitry 41 to determine such tag presence, resulting in the transmission of similar swept-frequency signals, but at a higher power level. This higher power level then produces breakdown between conductors on opposite sides of the tag's dielectric substrate, and thereby deactivation of the tag.

Not only may the basic operating principles be the same, but the same specific circuitry may also be used for important elements of the ED system as for the EAS system. In particular, the signal processing circuitry 41 of FIG. 2 may be substantially the same as the corresponding circuitry in the EAS system. Thus, circuitry 41 may include the processing circuitry of U.S. Pat. Nos. 3,828,337, and 4,117,466 previously mentioned herein.

In all other respects, the elements shown in FIG. 2 may take any one of a number of conventional forms, and are therefore not described in further detail.

It will be understood that the features of the present invention are not limited, in their application, to the specific equipment described with reference to FIGS. 1 and 2 herein. Rather, one or more of these features may be applied to a wide variety of other specific embodiments, including all those described in the above-mentioned U.S. Pat. No. 4,243,980. Accordingly, it is desired that the scope of this invention be delineated only by the appended claims.

I claim:

1. In a system for deactivating a tag which bears a resonant circuit made of conductors on opposite sides of a dielectric substrate by applying to said circuit sufficient RF power at its resonant frequency to disable said circuit through breakdown between said conductors, the improvement which comprises:

means for detecting the presence of said tag near said system;

means for responding to said detection to initiate a tag presence signal, said initiating means including means for detecting the presence of said tag near a pad housing an RF transmit antenna and an RF receive antenna:

means for sensing the cessation of said detection due to disablement of said circuit by said RF power;

means for extending the duration of said tag presence signal by a predetermined period of time beyond said sensing of cessation of detection; and means for responding to said detection to produce a signal capable of inhibiting the detection of the presence of a tag near another deactivating system.

2. The system of claim 1, wherein said signal is an audible signal.

3. The system of claim 2, wherein said audible signal is provided by a buzzer.

4. The system of claim 1, wherein said predetermined period is approximately 120 milliseconds.

5. The system of claim 1, further comprising means for maintaining said inhibiting signal for a period of time substantially equal to the extended duration of the tag presence signal.

6. The system of claim 1, wherein the means for producing the inhibiting signal is an optical coupling means.

7. The system of claim 1, wherein said improvement further comprises means for responding to said tag presence detection to raise said RF power to said level sufficient to disable said resonant circuit from a lower level, and means for responding to said detection to attenuate the signal supplied from the receive antenna to said presence detecting means.

8. The system of claim 7, wherein said improvement further comprises means for maintaining said power at its disabling level for a period substantially equal to the extended duration of the tag presence signal.

9. The system of claim 1, wherein the improvement comprises means for producing said RF power switchably under the control of a generator internal on the system or under the control of a signal supplied from outside said system.

10. The system of claim 1, in conjunction with an electronic article surveillance system for detecting the presence near said surveillance system of a tag which has not been disabled by said deactivating system.

11. In a system for deactivating a tag which bears a resonant circuit made of conductors on opposite sides of a dielectric substrate by applying to said circuit sufficient RF power at its resonant frequency to disable said circuit through breakdown between said conductors, the improvement which comprises:

means for detecting the presence of said tag near said system;

means for responding to said detection to initiate a tag presence signal, said initiating means including means for detecting the presence of said tag near a pad housing an RF transmit antenna and an RF receive antenna;

means for sensing the cessation of said detection due to disablement of said circuit by said RF power;

means for extending the duration of said tag presence signal by a predetermined period of time beyond said sensing of cessation of detection; and means for dissipating the disabling power principally within a cabinet separate from the pad which houses the transmit and receive antennas.

12. The system of claim 11, wherein the power dissipating means comprises a connection from the transmit antenna in the pad to the cabinet and a load within the cabinet supplied with the power to be dissipated via said connection.

13. In a system for deactivating a tag which bears a resonant circuit made of conductors on opposite sides of a dielectric substrate by applying to said circuit sufficient RF power at its resonant frequency to disable said circuit through breakdown between said conductors, in conjunction with an electronic article surveillance system for detecting the presence near said surveillance system of a tag which has not been disabled by said deactivating system, the improvement which comprises:

means for detecting the presence of said tag near said deactivating system;

means for responding to said detection to initiate a tag presence signal;

means for sensing the cessation of said detection due to disablement of said circuit by said RF power;

means for extending the duration of said tag presence signal by a predetermined period of time beyond said sensing of cessation of detection; and means for responding to said detection of a tag near the deactivating system to inhibit the detection of a tag by said surveillance system.

* * * * *